US006336630B1

(12) United States Patent
Holtman et al.

(10) Patent No.: US 6,336,630 B1
(45) Date of Patent: Jan. 8, 2002

(54) PRINTING APPARATUS FOR THE SELECTIVE DEPOSITION OF PRINTED SHEETS ON SUPPORTS WHICH ARE ADJUSTABLE AS TO HEIGHT

(75) Inventors: Lodewijk Taroisius Holtman, Venlo; Ronald P. H. in 't Zandt, Sevenum, both of (NL)

(73) Assignee: OCE-Technologies B.V., Venlo (NL)

( * ) Notice: Subject to any disclaimer, the term of this patent is extended or adjusted under 35 U.S.C. 154(b) by 0 days.

(21) Appl. No.: 09/109,075

(22) Filed: Jul. 2, 1998

(30) Foreign Application Priority Data

Jul. 4, 1997 (NL) ..... 1006471

(51) Int. Cl.[7] ..... B65H 39/11

(52) U.S. Cl. ..... 271/293; 271/288; 271/294; 271/298; 271/213; 271/215; 270/58.13; 270/58.15

(58) Field of Search ..... 271/287, 288, 271/292, 293, 294, 298, 299, 212, 213, 214, 215, 217, 218; 270/58.01, 58.08, 58.07, 58.13, 58.14, 58.15

(56) References Cited

U.S. PATENT DOCUMENTS 4,627,706 A * 12/1986 Takashashi et al. ..... 271/288 X
4,763,892 A * 8/1988 Tanaka et al. ..... 271/293
5,106,076 A * 4/1992 Fujita et al. ..... 271/287
5,284,339 A * 2/1994 Van Opstal et al. ..... 271/288

FOREIGN PATENT DOCUMENTS

EP 0208342 * 1/1987
EP 0532069 3/1993

* cited by examiner

*Primary Examiner*—Christopher P. Ellis
*Assistant Examiner*—Patrick Mackey
(74) *Attorney, Agent, or Firm*—Birch, Stewart, Kolasch & Birch, LLP

(57) ABSTRACT

A printing apparatus provided with a deposition unit for printed sheets comprising a number of copy trays situated one above the other, which trays are adjustable in height independent of one another to a deposition position with respect to the sheet delivery rollers disposed at a fixed height, and to a parking position. Upon the activation of the printing apparatus by a start key provided on the printing apparatus, a control system sets the bottom copy tray into a deposition position and the other copy trays into a higher parking position. Upon the activation of the printing apparatus by a start key disposed at a distance from the printing apparatus at a workstation, the control system selectively sets one of the other copy trays into a deposition position and the bottom copy tray into a lower parking position.

5 Claims, 6 Drawing Sheets

PRINTING APPARATUS FOR THE SELECTIVE DEPOSITION OF PRINTED SHEETS ON SUPPORTS WHICH ARE ADJUSTABLE AS TO HEIGHT

BACKGROUND OF THE INVENTION

The present invention relates to a printing apparatus for printing sheets and selectively depositing the printed sheets on supports which are adjustable in height, independent of each other, by utilizing a sheet deposition member disposed at a fixed location. Each support is movable between the highest deposition position and the lowest deposition position in which sheets can be deposited on the associated support. Each support is adapted to be positioned in a parking position in which sheets are not deposited on the associated support and in which the parking position of the bottom support is no higher than the lowest deposition position of the bottom support and the parking position of the supports situated above the bottom support is higher than the fixed sheet deposition member. A printing apparatus of this kind is known from European Patent 0 532 069.

Printing apparatus, including apparatus of the type indicated above, is increasingly used by different users who send images for printing to the printing apparatus via an electronic network from a location remote from the printing apparatus, and also start the printing apparatus at a location remote from the printing apparatus, e.g. from a workstation at the user's workplace. When users of this kind do not go to the printing apparatus in order to directly remove the prints after the sheets printed from them have been completed, but rather leave them there until a suitable future time occurs, there is the risk that prints from other users, who are also not present at the printing apparatus will land on the previous prints and fill the available deposition space at the printing apparatus. In the case of a printing apparatus of the type referred to in the preamble, in which the space required for moving the supports up and down is appreciably less than twice the space occupied by a maximum number of sheets to be deposited on the supports, the non-removal of said sheets results in a limitation of the available deposition space.

SUMMARY OF THE INVENTION

The object of the present invention is to provide a printing apparatus of the type referred to in the preamble, which can be operated both by a user at a distance from the printing apparatus and by a user located at the printing apparatus, while eliminating the problems discussed hereinabove. To this end, and according to the present invention, the printing apparatus is provided with a control key for setting the printing apparatus to the deposition of printing sheets on the bottom support. With this setting, each support situated above the bottom support is in its parking position and the bottom support is in its deposition position. When the printing apparatus is set to deposit printed sheets onto a support situated above the bottom support, then the bottom support is in its parking position and the support thereabove selected for deposition is in its deposition position. As a result, prints from a user who has started the printing operation by operating the control key on the printing apparatus arrive on the bottom support and can be removed directly, after printing, by the operator present at the printing apparatus.

A printing cycle of images originating from a workstation situated at a distance from the printing apparatus, which is activated at a printing apparatus, is known per se from European Patent 0 208 342. However, when an operator is located at the printing apparatus for the purpose of activating the same and immediately removes the finished prints, in the printing apparatus according to the present invention there are never a large number of prints on the bottom support so that the supports situated above the bottom support can be lowered to a point just above the parking position of the bottom support, in the absence of an operator at the printing apparatus, in order thus to create a maximum deposition space for prints for which the printing apparatus has been activated remotely by users at their workplace. The automatic production of prints without an operator being located at the printing apparatus can be restricted to bulky orders, e.g. multiple copy printing of reports, on supports situated above the bottom support, while the production of prints for which an operator should be located at the printing apparatus applies to the rest of the orders, e.g. small orders, the users of which are distributed over their own workplaces.

In one advantageous embodiment of the printing apparatus according to the present invention, the control key is formed by a start key on the printing apparatus, which when actuated, not only sets the printing apparatus to deposit printed sheets on the bottom support but also starts the printing of sheets which are to be deposited on the bottom support. As a result, no special control key has to be provided on the printing apparatus to ensure that the printed sheets in the case of prints initiated at the actual printing apparatus are deposited onto the bottom support of a number of supports, each independently adjustable as to height.

Preferably, the parking position of the bottom support is situated at a fixed predetermined distance below the lowest deposition position of the bottom support. As a result, the support situated directly above the bottom support is movable between its highest deposition position and its lowest deposition position without sheets deposited on the bottom support having to be removed. Thus, the support situated immediately above the bottom support can always be placed directly in its deposition position, this naturally being advantageous for the deposition of printed sheets during an interruption of a running print order (i.e., for an intermediate print order).

In another advantageous embodiment of a printing apparatus according to the present invention, the top support of the supports which are adjustable independently of one another is adapted to be placed in its bottom deposition position only when there are no sheets situated between at least two supports positioned lower than the fixed sheet deposition member. As a result, the supports can be placed as close as possible to one another so that a high deposition capacity is achieved in a relatively small deposition space.

BRIEF DESCRIPTION OF THE DRAWINGS

Other features and advantages of the present invention will be explained hereinafter with reference to the accompanying drawings wherein.

DETAILED DESCRIPTION OF THE INVENTION

Figure 1:
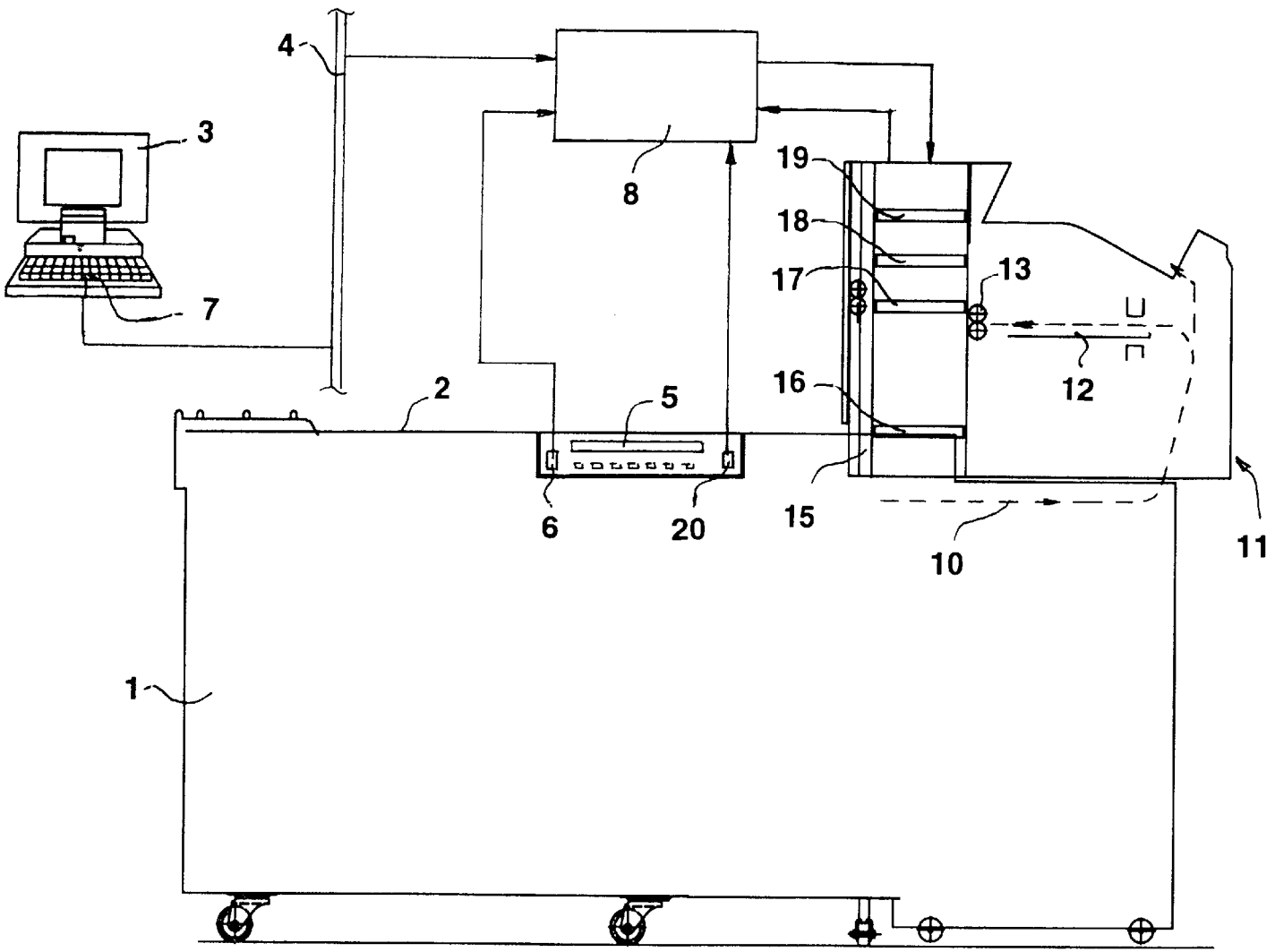
FIG. 1 shows one embodiment of a printing apparatus according to the invention.

The printing apparatus 1 shown in FIG. 1 comprises means known per se for printing an image on a receiving sheet. These images for printing may be present on original documents fed to a scanning station 2 situated at the top of the printing apparatus 1. Images for printing can also be presented in digital form at a workstation 3 connected via a network 4 to a control device 8 of the printing apparatus 1. A printing cycle for copying a set of originals presented at the scanning station 2 is started by operating a start key 6 present on the operating panel 5 of the printing apparatus 1.

A printing cycle for printing a set of images presented at the workstation 3 can be started by operating a start key 7 at the workstation 3, via control device 8 (hereinafter referred to as automatic printing) or by operating the start key 6 on the operating panel 5 of the printing apparatus 1 (hereinafter referred to as semi-automatic printing).

In the semi-automatic printing described in European Patent Application 0 208 342, a set of images for printing is transmitted via a network from the workstation to the printing apparatus, but printing is not started until the operator, after receiving the print order at the printing apparatus 4, has operated the start key. This semi-automatic printing offers the operator the opportunity of checking the settings at the printing apparatus and changing them, if necessary, directly prior to the operation of the start key and in order to remove the prints immediately after completion of the print order. In the case of print orders of a limited size carried out on a high-speed printing apparatus, e.g. a printing apparatus which can produce more than 80 prints per minute, the time between operating the start key and completion of the printing is so short that the operator hardly considers this to be a waiting period and hence remains at the printing apparatus until the prints are ready for removal. Prints made in this way will therefore normally not stay at the printing apparatus since the person giving the order for these prints is in the immediate vicinity. Thus there is little risk of a large number of semi-automatic prints collecting at the printing apparatus and causing congestion. In the case of extensive print orders which take up a lot of time, the person giving the print order will probably not wait at the printing apparatus for the entire period until his prints are ready, but will use this time for other activities, e.g. at a workstation remote from the printing apparatus. In this case, it is accordingly not very rational to compel a person giving a print order from his workstation to start the print order at the actual printing apparatus, and it is more logical to start such extensive print orders automatically from the workstation. The person giving the order or the operator does not then need to go to the printing apparatus until his prints are ready. To summarize, therefore, a distinction can be made between the following types of print orders:

1) Print orders consisting of copying a set of original documents offered from a scanning station present on the printing apparatus (hereinafter referred to as "copying"),
2) Print orders (of limited size) offered from a workstation connected via a network to the printing apparatus and started by operation on the printing apparatus (hereinafter referred to as "interactive or semi-automatic printing"), and
3) Print orders (of extensive size) offered and started from a workstation connected to the printing apparatus via a network (hereinafter referred to as "automatic printing").

In the printing apparatus 1 as shown in FIG. 1, sheet transport path 10 forms the path for discharging sheets printed in the printing apparatus to a sheet finishing station 11. The finishing station 11 contains a sheet collecting tray 12 (not shown in detail), in which a number of printed sheets, each belonging to a set, can be collected and stapled. Pairs of delivery rollers 13 deliver the set to a sheet delivery unit 15 forming part of a sheet delivery station 11. The sheet delivery unit 15 contains four copy trays 16, 17, 18 and 19 situated one above the other and each being lowerable to a deposition position with respect to the horizontal delivery path formed by the delivery roller pair 13, in order to receive sheets delivered by the pair of delivery rollers 13. The vertical displacement of the copy trays can be effected by means of the displacement mechanism described in European Patent 0 532 069, in which the selected copy tray or the top sheet thereon is always situated just beneath the delivery path formed by the pair of delivery rollers.

In FIG. 1, the bottom copy tray 16 is shown in a bottom deposition position, in which a maximum number of sheets are situated on the copy tray 16. The copy trays 17, 18 and 19 disposed thereabove are in parking positions which are situated above the delivery path formed by the pair of delivery rollers. Since the copy trays 17, 18 and 19 are adjustable as to height independently of the copy tray 16, the top copy tray 19 can, after the sheets have been removed from copy tray 16, also be placed in a deposition position without the bottom copy tray 16 having to be moved further than in its bottom deposition position shown in FIG. 1. As a result, the finishing station 11 with the sheet delivery unit 15 positioned adjacent thereto is very suitable for placing at the top of a printing apparatus 1, the top of which is situated with the scanning station 2 at a normal working height of about 100 cm for a standing operator. In the printing apparatus shown in FIG. 1 with the finishing station 11, the removal height for sheets deposited on the copy trays 16, 17, 18 and 19 is between 100 and 160 cm for a total sheet delivery capacity of about 3000 sheets. The sheet deposition level determined by the fixed delivery rollers 13 is approximately 133 cm, and this level corresponds to the deposition level at which the bottom copy tray 16 is in its lowest deposition position. The combination of high deposition capacity and limited overall height is made possible by using the printing apparatus in accordance with the steps of the present invention, i.e. by using the bottom copy tray 16 solely for the deposition of prints, the print cycle of which is initiated with a setting key on the printing apparatus, so that the operator who carries out this setting can also remove the deposited prints shortly thereafter. This gives the copy trays situated thereabove the opportunity of coming into their deposition position and receiving prints whose print cycle has been initiated from the workstation 3 which is remote from the printing apparatus.

The operation of the printing apparatus, according to the present invention, will now be explained further with reference to FIGS. 2 to 5, which illustrate in greater detail and in different positions the deposition station 11 shown in FIG. 1.

Figure 2:
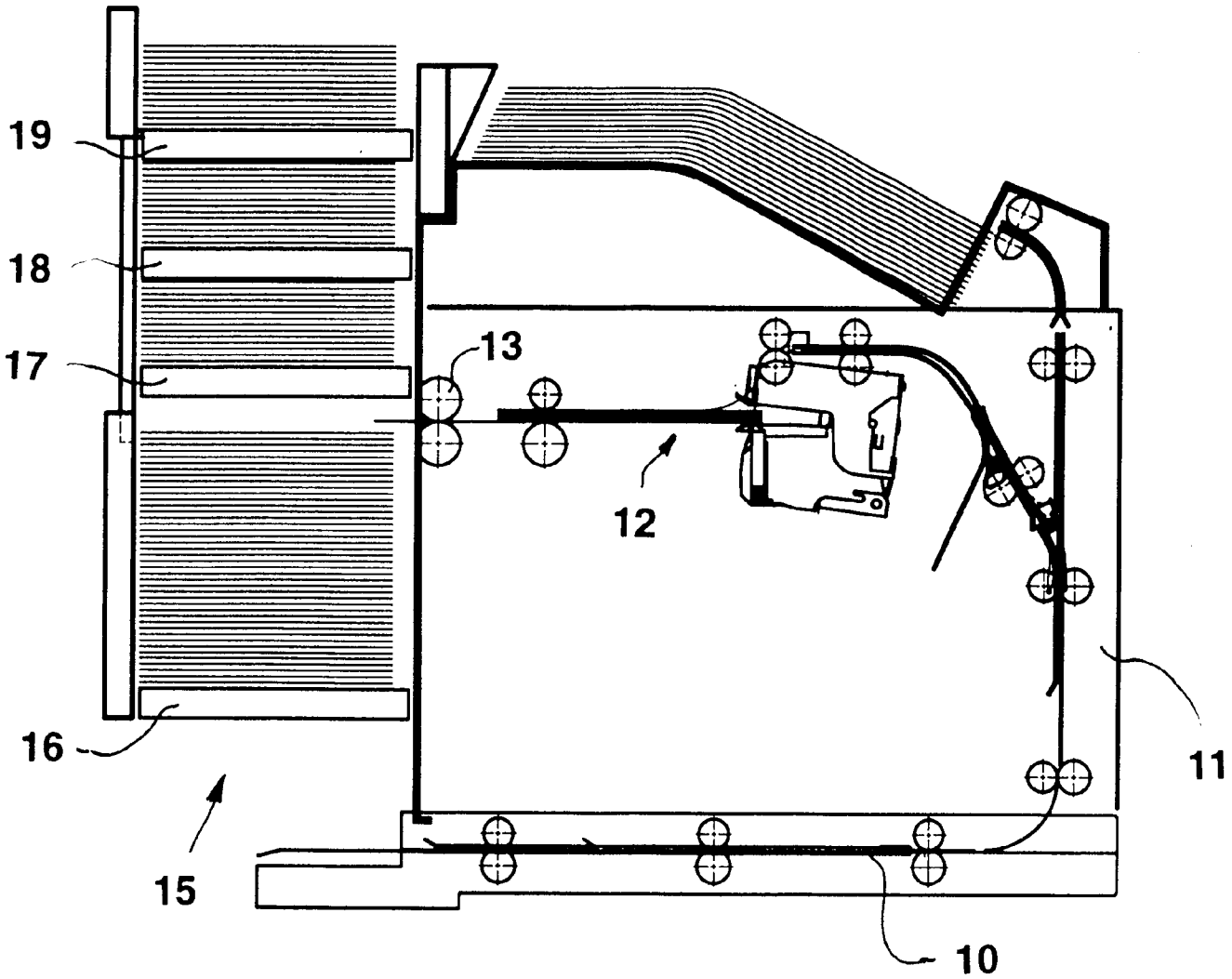
FIG. 2 shows part of the printing apparatus of FIG. 1 in a position in which sheets are deposited on the bottom support.

FIG. 2 shows the situation in which the copy trays 16, 17, 18, 19 disposed one above the other each carry a maximum number of sheets, the bottom tray 1500 sheets and each of the trays situated thereabove 500 sheets, making a total of 3000 sheets. The ergonomic removal height is between 100 and 160 cm from the floor in the case of a delivery height of between 130 and 140 cm from the floor (ergonomic in order to remedy malfunction and refill staples at the collecting tray 12 at the same height).

Figure 3:
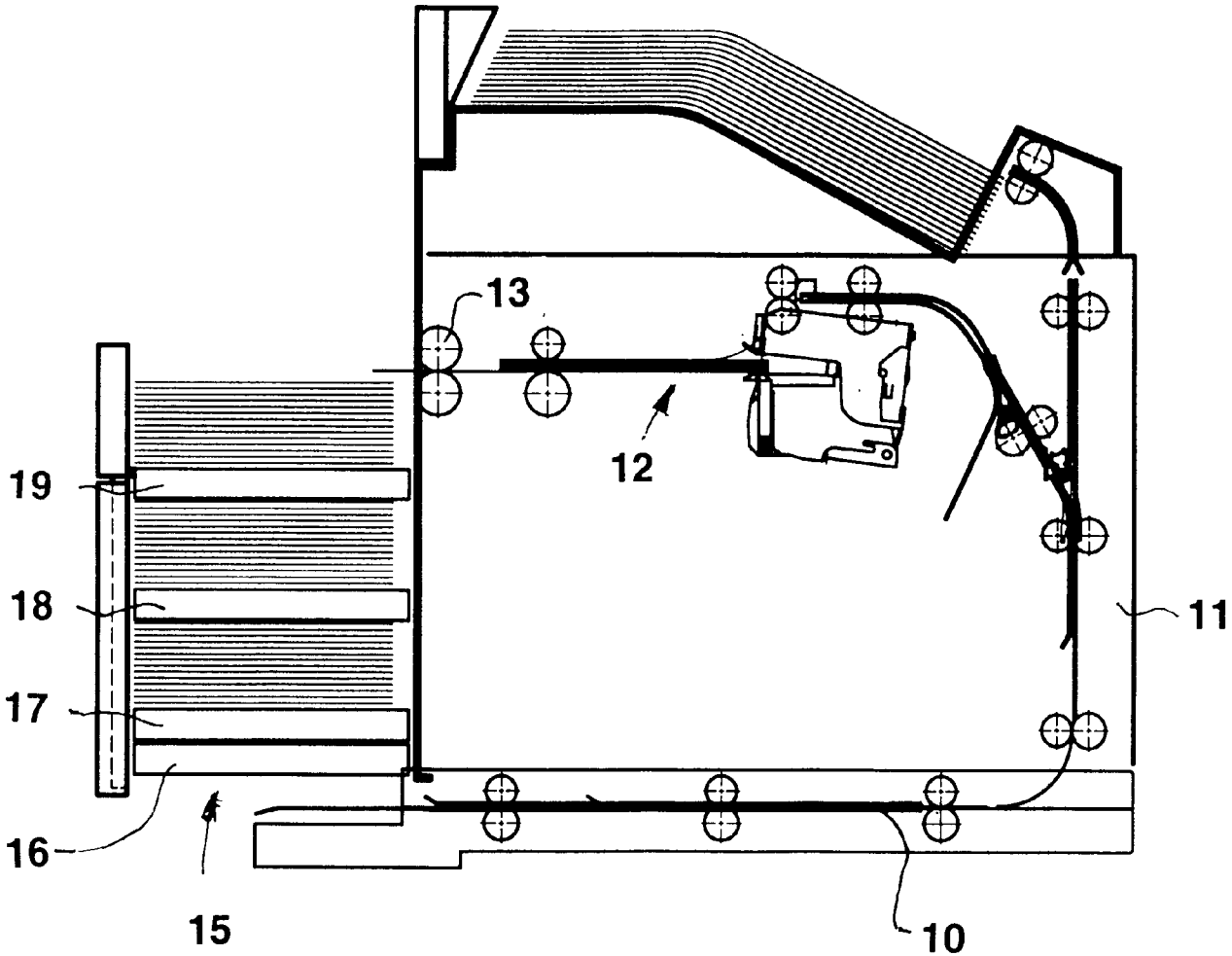
FIG. 3 shows the part of the printing apparatus according to FIG. 2 in a position in which sheets are deposited on the top support.

In the case of a delivery height of about 135 cm, the top three copy trays 17, 18 and 19 with a maximum number of 500 sheets to be deposited on each tray, are situated beneath the delivery level of delivery roller pair 13, at least when there are no sheets on the bottom copy tray 16. This situation is shown in FIG. 3. Thus, in the absence of sheets on the bottom copy tray 16, sheets can be deposited on each of the trays 17, 18 and 19 up to their maximum capacity of 500 sheets, without sheets having to be removed in the meantime from one of the trays 17, 18 and 19. It is preferable to start depositing sheets on the trays 17, 18 and 19 at tray 17 and then continue on tray 18 and 19. The reason for this is that tray 17 can come most quickly into the deposition position from its parking position situated directly above the delivery level, and because it is only on deposition of sheets on the top tray 19 that all the sheets have to be removed from the bottom copy tray, this situation being shown in FIG. 3. It is also preferable initially to place the trays 17, 18 and 19 directly above one another above the delivery level so that they can be moved most rapidly into the deposition position.

To summarize, a situation arises in which, without interruption to the removal of sheets, the top three copy trays 17, 18 and 19 can first be successively loaded each with 500 sheets and then, by placing the copy trays 17, 18 and 19 in a position above the delivery level formed by the delivery rollers (FIG. 2), copy tray 16 can be placed in its top deposition position just beneath the delivery level. In order to ensure that the top three copy trays 17, 18 and 19 can, without difficulty, be placed in any possible deposition position, no sheets should be situated on the bottom copy tray 16, as already stated. The risk of sheets remaining on the bottom copy tray 16, and being entrained immediately after their deposition, is greatest when sheets are deposited on the bottom copy tray 16 only when the operator is situated at the printing apparatus during the making of his prints, so that directly after the completion of the print order intended for him the operator can immediately take away his prints. According to the present invention, this is achieved by allowing a print order to take place with deposition on the bottom copy tray 16 only when the operator operates an adjustment key on the printing apparatus. A print order of this kind may consist of a copying order, in which an operator presents originals for copying to the scanning station 2 on the printing apparatus or a print order in which an operator automatically sends to the printing apparatus 1 via a network 4 information for printing from a workstation 3. The workstation is situated at a distance from the printing apparatus 1, and printing does not start until a start key 6 on the operating panel 5 of the printing apparatus 1 has been operated (semi-automatic or interactive printing). A print order with sheets deposited on the top three trays can be completely controlled from the workstation 3 situated at a distance from the printing apparatus 1, thus sending both the information for printing and the actuation of the printing apparatus by means of key 7 (automatic printing).

Automatic printing with sheets deposited on copy trays 17, 18 and 19 can be interrupted at any time for a copying order or a semi-automatic print order. In such cases, the copy tray 17, 18 and 19 reserved for automatic print orders is temporarily set in a parking position above the delivery rollers 13. When the prints made during the interruption are removed from the bottom copy tray 16 directly after completion of the order, the automatic print order can be resumed with deposition on the top copy trays up to their maximum capacity (FIG. 3). If, however, sheets remain on the bottom copy tray 16, then a downward displacement of the top three copy trays is restricted, for example, to the bottom two copy trays 17 and 18 of the top three copy trays 17, 18 and 19. From a delivery position occupied by one of the copy trays 17, 18 or 19, the printing apparatus 1 can be directly adjusted to the making and deposition of printed sheets on the bottom copy tray 16 by activating the printing apparatus by means of the start key 5 on the operating panel 4 of the printing apparatus. In these conditions the copy trays 17, 18 and/or 19 move up to positions above the delivery rollers without deposited sheets having to be removed from these trays, as shown in FIG. 1.

Figure 4:
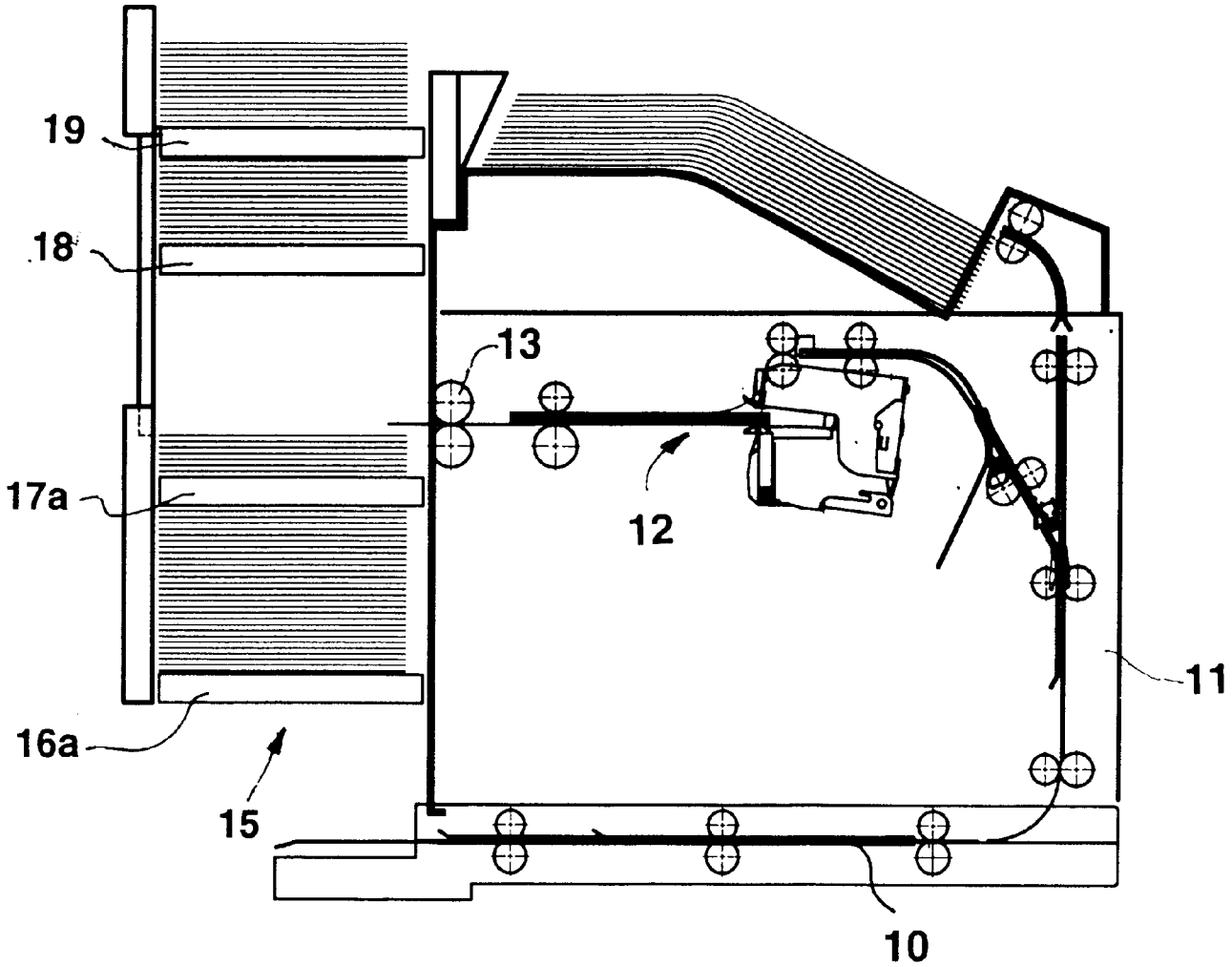
FIG. 4 shows the part of the printing apparatus of FIG. 2 in a position in which sheets of an intermediate print order are deposited on the support situated directly above the bottom support.

FIG. 4 shows the sheet delivery unit 15 in the case of a printing apparatus 1 according to another aspect of the present invention in which the copy tray 17*a* situated directly above the bottom copy tray 16*a* is intended to enable sheets to be deposited at all times, even when there is a predetermined maximum number of sheets on the bottom copy tray 16*a*. This desired situation may occur if an operator wishes to interrupt a (long) running print order in which prints are deposited on the bottom copy tray 16*a*, in order to make in the interim a (short) print order. By so restricting the predetermined maximum number of sheets to be deposited on the bottom copy tray 16*a* (e.g. to 1000 sheets instead of 1500 sheets), the copy tray 17*a* situated directly thereabove can always be placed in a deposition position by moving the bottom copy tray 16*a* from the bottom deposition position further down over a distance corresponding to the height occupied by the sheets of the intermediate order which are to be inclusively deposited by means of copy tray 17*a*.

FIG. 4 shows the situation in which the copy tray 17*a*, especially reserved for intermediate orders, carries a predetermined maximum number of sheets, e.g. 250 sheets. Intermediate orders are started by operating an intermediate start key 20 intended specially for this purpose on the operating panel 5 (see FIG. 1).

Figure 5:
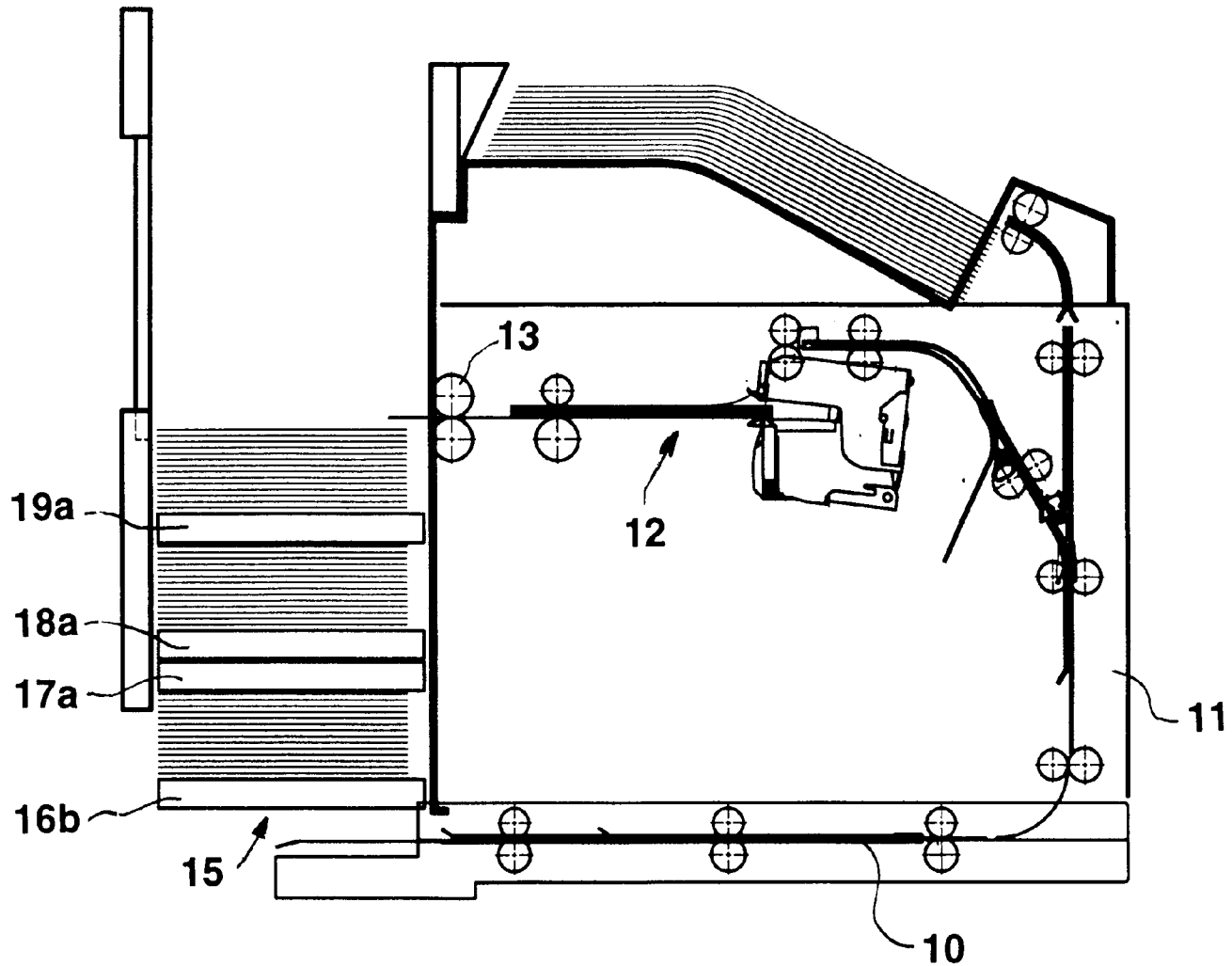
FIG. 5 shows the part of the printing apparatus of FIG. 2 in which sheets are deposited on the top support without all the sheets having been removed from the bottom support.

FIG. 5 shows a sheet delivery unit 15 in the case of a sheet printing apparatus 1 according to yet another aspect of the present invention wherein the deposition capacity of the bottom copy tray 16*b* is further restricted (e.g. to 500 sheets) in comparison with the embodiment shown in FIG. 4, in such manner that the top two copy trays 18*a* and 19*a* can always be placed in a working position for the deposition of sheets thereon up to a predetermined maximum capacity without sheets deposited on the bottom support 16*b* having to be removed.

Figure 6:
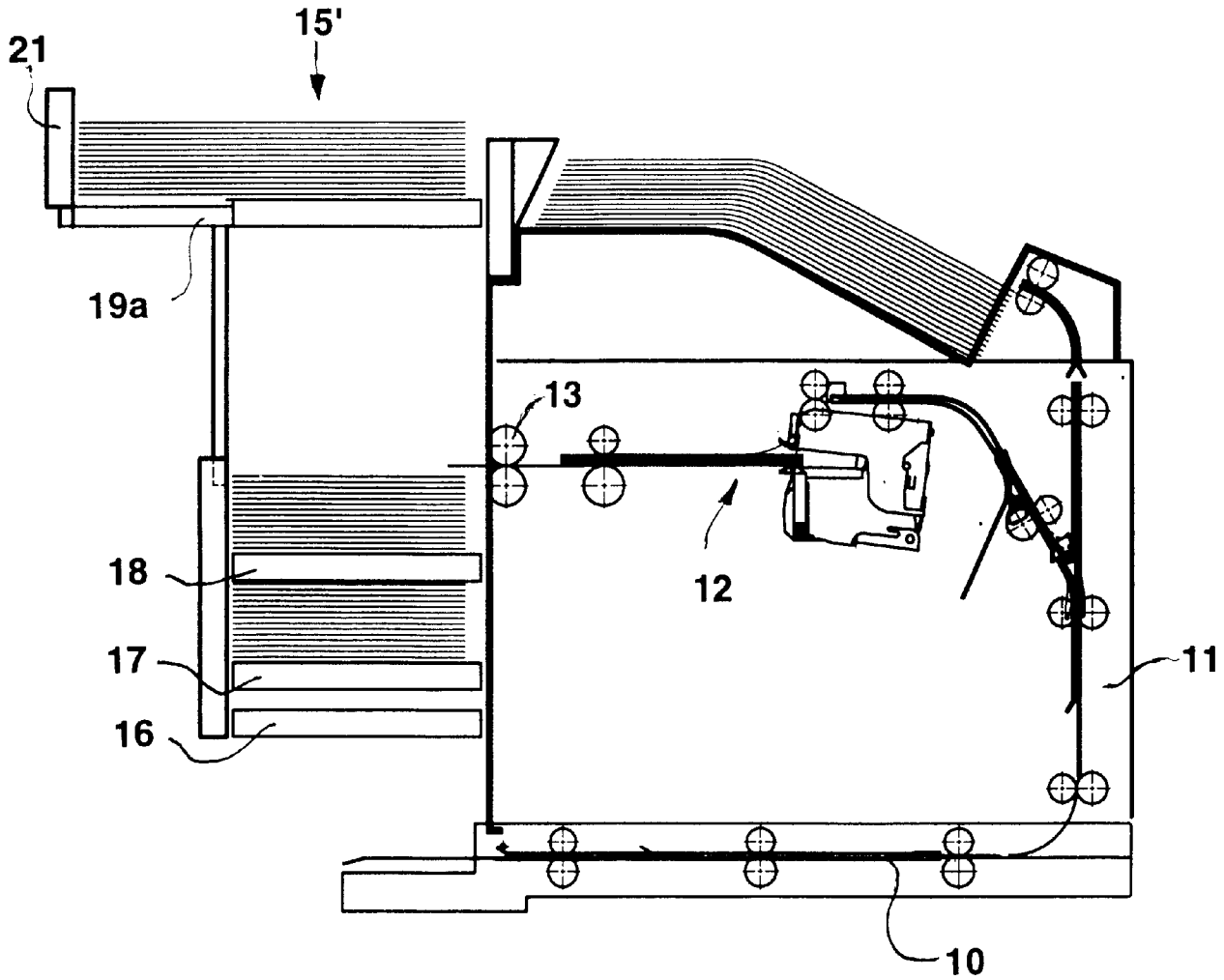
FIG. 6 shows a second embodiment of a part of a printing apparatus according to the present invention.

FIG. 6 shows an embodiment of a sheet delivery unit 15' in which the top copy tray 19*a* is arranged to receive sheets which, when considered in the deposition direction, are longer than the sheets which can be deposited on the other copy trays 16, 17 and 18. To this end, that side of the copy tray 19*a* which is situated opposite to the delivery rollers is provided with an abutment strip 21 which can be extended to the position shown in FIG. 6.

A sensor (not shown) which detects the extended position of the abutment strip 21 delivers a signal to the control device 8 of the printing apparatus 1 in order to exclude the copy tray 19*a* for the deposition of sheets in a format smaller than the position corresponding to the extended position of the abutment strip 21.

As explained hereinbefore, the printing apparatus 1 can thus be arranged for:

the deposition of print orders started at the printing apparatus 1 (copying orders and interactive print orders) on the bottom copy tray 16, 16*a* or 16*b* up to a predetermined maximum (1500, 1000 or 500 sheets respectively). The printing of different orders can be separated from one another by banner pages preceding each order, the deposition of prints made during an interruption to a running print order, on the copy tray 17*a* situated directly above the bottom copy tray 16*a*, to a predetermined maximum, e.g. 250 sheets, wherein printed sheets of the interrupted print order do not have to be removed beforehand, the deposition of large-format prints on a top copy tray 19*a* adapted thereto, up to a predetermined maximum of e.g. 500 sheets, the deposition of print orders (automatic print orders) started from a workstation 3 situated at a distance from the printing apparatus, on the copy tray 18*a* situated directly beneath the top copy tray 19*a*, up to a predetermined maximum of e.g. 500 sheets.

Because of the different deposition locations where prints of a print order can arrive, it is advantageous to provide the delivery unit 15 with a display showing thereon the copy tray from which prints of any specific print order can be removed.

Instead of the embodiments of the delivery unit 15 described hereinbefore, in which each copy tray is separately adjustable as to height, an embodiment is possible in which the top three copy trays are adjustable in height as a unit. This simpler and cheaper embodiment retains the advantage that there is no need for the entire deposition capacity of the delivery unit 15 to fit beneath the delivery level formed by the delivery roller pair 13, but it is also less flexible, for example because the deposition situation shown in FIG. 5 can no longer be achieved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A printing apparatus for printing sheets and selectively depositing the printed sheets on supports disposed within a sheet delivery unit provided with a fixed sheet deposition member disposed at a fixed location, relative to the sheet delivery unit, said supports being adjustable in height, independent of one another, each support being movable between a highest deposition position and a lowest deposition position in which sheets can be deposited on the respective supports and each support being adapted to be positioned in a parking position where sheets cannot be deposited on the respective supports and in which the parking position of the bottom support is no higher than the lowest deposition position of the bottom support and the parking position of the remaining supports situated above the bottom support is higher than the fixed sheet deposition member, wherein the printing apparatus is provided with a control key for exclusively setting the printing apparatus to deposit printed sheets on the bottom support.

2. The printing apparatus according to claim 1, wherein the control key is formed by a start key on the printing apparatus, which when operated starts the printing of sheets which are to be deposited on the bottom support.

3. The printing apparatus according to claim 1, wherein the parking position of the bottom support is situated at a fixed predetermined distance beneath the lowest deposition position of the bottom support.

4. The printing apparatus according to claim 1, wherein other remaining supports have the top support which is adapted to be placed in its bottom deposition position when there are no sheets situated between at least two supports positioned lower than the fixed sheet deposition member.

5. The printing apparatus according to claim 4, wherein the top support is adjustable to support sheets which have a larger format than sheets which are adapted to be deposited on the remaining supports situated beneath the top support.

* * * * *